US009352327B2

(12) United States Patent
Schmidt et al.

(10) Patent No.: US 9,352,327 B2
(45) Date of Patent: May 31, 2016

(54) GRINDER PUMP BASIN SYSTEM

(71) Applicant: Zoeller Pump Company, LLC, Louisville, KY (US)

(72) Inventors: William L. Schmidt, Leitchfield, KY (US); David R. Gilbert, Louisville, KY (US); Bryan S. Schilling, Louisville, KY (US); Charles P. Carroll, Louisville, KY (US)

(73) Assignee: ZOELLER PUMP COMPANY, LLC, Louisville, KY (US)

( * ) Notice: Subject to any disclaimer, the term of this patent is extended or adjusted under 35 U.S.C. 154(b) by 0 days.

(21) Appl. No.: 13/914,708

(22) Filed: Jun. 11, 2013

(65) Prior Publication Data

US 2013/0270375 A1 Oct. 17, 2013

Related U.S. Application Data

(60) Division of application No. 13/326,759, filed on Dec. 15, 2011, which is a continuation-in-part of application No. 12/749,153, filed on Mar. 29, 2010, now abandoned, and a continuation-in-part of application No. 12/749,134, filed on Mar. 29, 2010, now Pat. No. 8,562,287.

(60) Provisional application No. 61/219,657, filed on Jun. 23, 2009.

(51) Int. Cl.

| | |
|---|---|
| ***B02C 18/00*** | (2006.01) |
| ***F04D 7/04*** | (2006.01) |
| ***F04D 29/22*** | (2006.01) |
| *E03F 5/22* | (2006.01) |

(52) U.S. Cl.

CPC ..... *B02C 18/0092* (2013.01); *F04D 7/045* (2013.01); *F04D 29/2288* (2013.01); *E03F 5/22* (2013.01)

(58) Field of Classification Search

CPC . B02C 18/0084; B02C 18/0092; F04D 7/045; F04D 29/2288; D21B 1/345

USPC ..... 241/46.11, 46.01–46.017, 185.6; 415/121.1, 121.2, 206; 210/173; 417/430, 431

See application file for complete search history.

(56) References Cited

U.S. PATENT DOCUMENTS

| | | | | | |
|---|---|---|---|---|---|
| 2,424,726 | A | * | 7/1947 | Wells | 241/46.11 |
| 2,496,017 | A | * | 1/1950 | Newell et al. | 241/46.017 |
| 2,676,666 | A | * | 4/1954 | Howe | 210/111 |
| 2,858,990 | A | * | 11/1958 | Honeyman | 241/261.1 |
| 3,009,656 | A | * | 11/1961 | Martindale | 241/46.17 |
| 3,155,046 | A | * | 11/1964 | Vaughan | 415/206 |
| 3,650,481 | A | * | 3/1972 | Conery et al. | 241/46.11 |
| 3,713,594 | A | * | 1/1973 | Blakley et al. | 241/46.08 |
| 3,726,486 | A | * | 4/1973 | Smith et al. | 241/46.11 |

(Continued)

*Primary Examiner* — Alexander Comley
(74) *Attorney, Agent, or Firm* — Scott R. Cox

(57) ABSTRACT

A grinder pump basin system is provided which includes a basin; a cover plate; a bracket secured to the cover plate; and a grinder pump with cutter plate with openings and a cutter blade secured to the bracket above a bottom surface of the basin. The openings in the cutter plate have an unique shape which assists in the cutting of material which flows through an inlet of a grinder pump. The shape of the cutter blade cooperates with the openings in the cutter plate such that solids are forced between these respective components and thereby are efficiently cut into small pieces for passing through the openings and for discharge from the grinder pump basin system.

17 Claims, 13 Drawing Sheets

(56) References Cited

U.S. PATENT DOCUMENTS

| | | | | | |
|---|---|---|---|---|---|
| 3,738,581 | A * | 6/1973 | Gallauresi et al. | 241/46.02 |
| 3,774,853 | A * | 11/1973 | Seifert | 241/46.11 |
| 3,843,063 | A * | 10/1974 | Honeyman | 241/46.11 |
| 4,109,872 | A * | 8/1978 | Couture | 241/46.11 |
| 4,183,470 | A * | 1/1980 | Hovartos et al. | 241/46.013 |
| 4,480,796 | A * | 11/1984 | Paraskevas | 241/46.11 |
| 4,535,943 | A * | 8/1985 | Couture | 241/46.02 |
| 4,842,479 | A * | 6/1989 | Dorsch | 415/121.1 |
| 4,911,368 | A * | 3/1990 | Nishimori | 241/46.017 |
| 5,256,032 | A * | 10/1993 | Dorsch | F04D 7/045 415/121.1 |
| 5,918,822 | A * | 7/1999 | Sternby | 241/46.17 |
| 6,000,840 | A * | 12/1999 | Paterson | 366/264 |
| 6,190,121 | B1 * | 2/2001 | Hayward et al. | 415/121.1 |
| 6,234,415 | B1 * | 5/2001 | Liin | 241/46.11 |
| 6,705,554 | B1 * | 3/2004 | Kolle | 241/46.11 |
| 6,708,910 | B2 * | 3/2004 | Moore, Jr. | 241/46.11 |
| 7,159,806 | B1 * | 1/2007 | Ritsema | 241/46.06 |
| 7,628,890 | B2 * | 12/2009 | Chupka et al. | 162/261 |
| 8,216,426 | B1 * | 7/2012 | Urps | 162/234 |

* cited by examiner

GRINDER PUMP BASIN SYSTEM

RELATED APPLICATIONS

This Application is a divisional application of application Ser. No. 13/326,759 filed on Dec. 15, 2011, which application is continuation-in-part application claiming priority from application Ser. No. 12/749,153, filed Mar. 29, 2010, now abandoned, which claimed priority from provisional Application No. 61/219,657, filed Jun. 23, 2009 and application Ser. No. 12/749,134, filed Mar. 29, 2010, which also claimed priority from provisional Application No. 61/219,657, filed Jun. 23, 2009.

FIELD OF INVENTION

This invention relates to basin systems which hold pumps, particularly grinder pumps and the design of the cutting system of the grinder pumps. More particularly, this invention relates to a grinder pump basin system, wherein the grinder pump is secured to a bracket within a basin, wherein the grinder pump is not attached directly to a cover plate of the basin and wherein the grinder pump is located at a position above a bottom surface of the basin and the design of the cutting system of the grinder pump. The design of this grinder pump system creates a flow path for incoming wastewater that prevents solid and fibrous materials from depositing on the pump or float switches of the system. This invention further relates to a basin system with a grinder pump that includes directional flow jets in discharge piping from the grinder pump to further prevent solids and fibrous materials from depositing on the pump and float switches.

BACKGROUND OF INVENTION

This section is intended to introduce the reader to art that may be related to various aspects of the present invention, which are described and/or claimed below. This discussion is believed to be helpful in providing the reader with background information to facilitate a better understanding of the present invention. Accordingly, it should be understood that these statements are to be read in that light and not as admissions of prior art.

Sump pumps, grinder pumps, and other types of submersible pumps have been placed in basins and used for the removal of waste water and solids from those basins for many years. To use such pumps, they are placed in a basin which receives waste water, which water may also include solids. For example, waste water disposal systems are often used in sewage systems for grinding and pumping waste water that contains solids.

Such systems include a grinder pump, having a grinder mechanism for cutting or grinding solid or semi-solid matter in waste water present within the basin. Such waste water disposal systems may be installed outdoors underground or can be placed indoors in a lower portion of a structure, such as a basement of a home. Drawbacks to installing waste water disposal system outdoors include excavating the site and connecting the system to a waste water pipe, along with running electrical wires to the system to control its operation.

Because of the nature of the solid or semisolid materials that are contained in waste water, clogging of these systems is often a problem. This solid or semisolid material often interferes with the operation of the pump. To reduce this interference, in one embodiment these grinder pumps are secured to a cover plate of the basin in which the grinder pump is placed, thereby creating open space within the basin below the grinder pump, which permits waste water and solids to collect in the basin at a location below the grinder pump. Notwithstanding, these system fail to address clogging issues that may occur from the input of the waste water containing solids that enters the basin through a wall of the basin which adversely interacts with the operation of the grinder pump. In addition, sediment may build up in the bottom of these basins, which also interferes with the operation of the system.

An additional problem with current grinder pump basin systems is that when these grinder pumps are in operation grinding up solid or semisolid materials, a significant amount of vibration and torquing occurs, which vibration and torque impact the longevity of the grinder pump basin system and its components.

Further, current grinder pumps are sometimes not efficient in grinding up the solids that are present in the waste water or the solids clog the grinder pump.

Accordingly, it is one object of the invention to provide an improved grinder pump basin system with an improved cutting system for the grinder pump which addresses and overcomes these difficulties. Other objects are addressed by the disclosures and claims contained herein.

SUMMARY OF THE INVENTION

The present invention relates to a novel grinder pump basin system comprising a basin to receive waste water and solids; a cover plate for the basin that closes an open end of the basin; a bracket secured to an inside surface of the cover plate of the basin; and a grinder pump secured to the bracket at a location above a bottom surface of the basin, wherein the grinder pump is not attached directly to the cover plate. Preferably, the bracket secures the grinder pump at a location above a bottom surface of the basin such that a portion of the waste water and solids that enter the basin occupies an area in a bottom portion of the basin below the grinder pump.

In a further embodiment the bracket of the grinder pump basin system comprises a front portion, secured to an inside surface of the cover plate of the basin, which front portion extends downward to a location adjacent to or below a bottom portion of the grinder pump; a rear portion, which is also secured to the inside surface of the cover plate of the basin and also extends downward to a location adjacent to or below the bottom portion of the grinder pump; and a lower portion attached to, or a continuation of, the front portion and the rear portion of the bracket, which lower portion extends around and/or under the grinder pump and to which the grinder pump is secured. A bottom portion of the grinder pump, that includes a cutter plate and a cutter blade, extends through an opening in the lower portion of the bracket where that portion interacts with waste water and solids contained in the basin.

In a further embodiment, the basin further comprises an inlet opening in a side of the basin located such that waste water and solids that enter the basin under force strike the front portion of the bracket and are substantially prevented from directly impacting the grinder pump upon entry into the basin by this bracket. Further, and preferably, the front portion of the bracket is angled to preferentially direct the flow of waste water and solids that enter the basin through the inlet from a direction perpendicular to the flow of the waste water and solids to one or both sides of the grinder pump and/or toward the bottom portion of the basin.

In a further preferred embodiment, the grinder pump basin system further comprises a discharge system for discharging waste water and ground up solids from the basin, wherein the discharge system comprises a pump discharge outlet secured to the grinder pump, a discharge pipe which extends through the cover plate and is designed to discharge waste water and ground up solids through the cover plate of the basin, and a flexible discharge coupling secured to both the pump discharge outlet and the discharge pipe. Alternatively, discharge from the basin may be through a discharge pipe passing through the side of the basin.

In a further preferred embodiment, flow directional jets are provided in the discharge system, preferably in an elbow thereof, to direct a portion of the waste water being discharged from the basin in predetermined directions within the basin, preferentially away from components of the grinder pump or float switches which are attached to the grinder pump or the bracket.

In a further preferred embodiment, the bottom portion of the grinder pump includes a cutter plate with uniquely shaped openings therein which act in coordination with a uniquely shaped cutter blade to effectively and efficiently cut up solids in the waste water that enter the openings in the cutter plate while the grinder pump is operating.

These and other embodiments are achieved by the products disclosed in the drawings, the detailed description and the products, as claimed and as disclosed herein.

While the present disclosure describes various embodiments of the various inventions, it is not limited by the disclosures contained within the drawings or specification. The drawings describe at least one presently preferred embodiment and should be considered an exemplification thereof. They are not intended to limit the invention to any specific embodiment or embodiments described therein.

DETAILED DESCRIPTION

Figure 1:
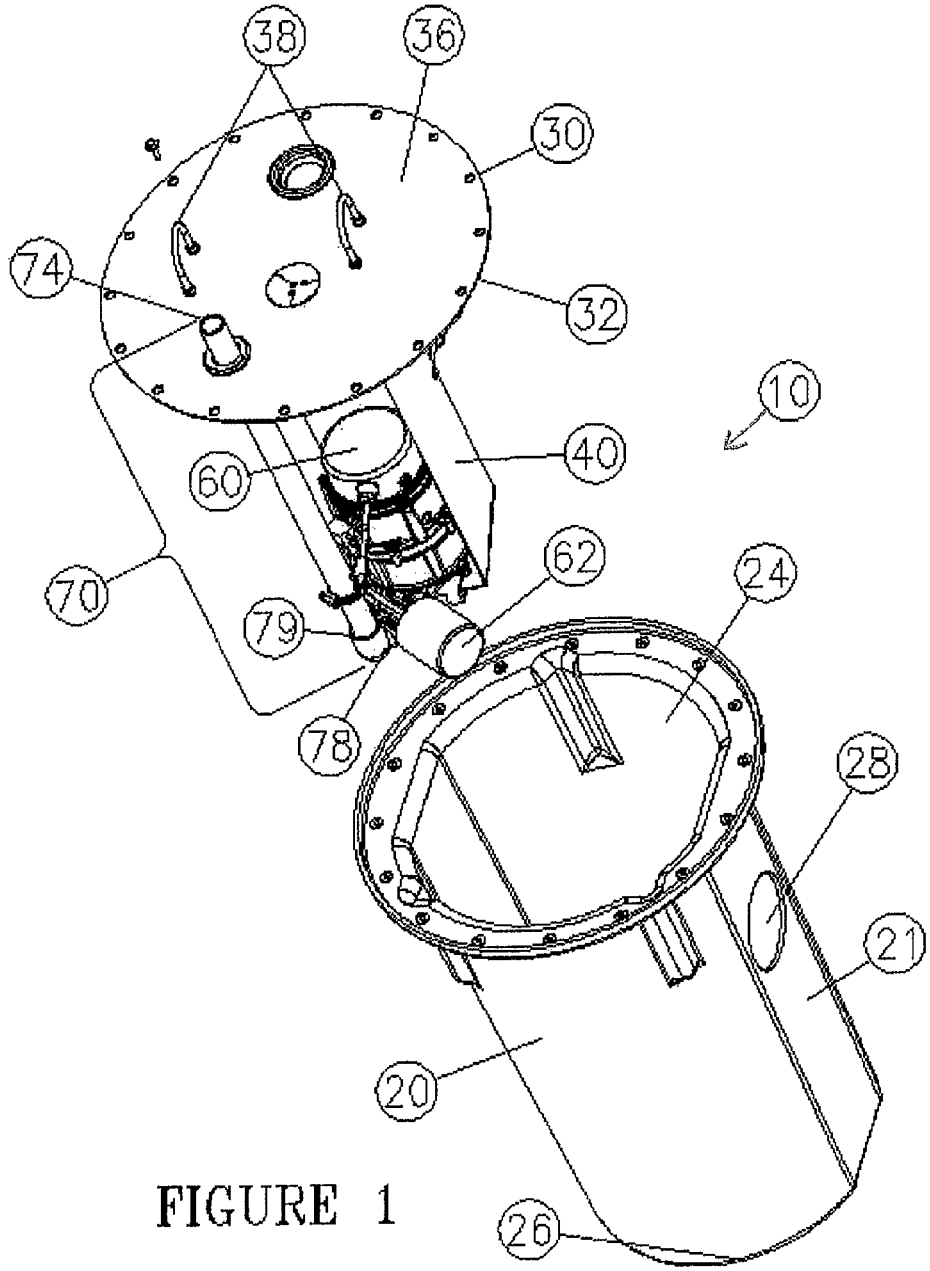
FIG. 1 is a perspective, exploded view of the grinder pump basin system containing a basin, a bracket secured to an inside surface of a cover plate of the basin and a grinder pump secured to the bracket.
Figure 2:
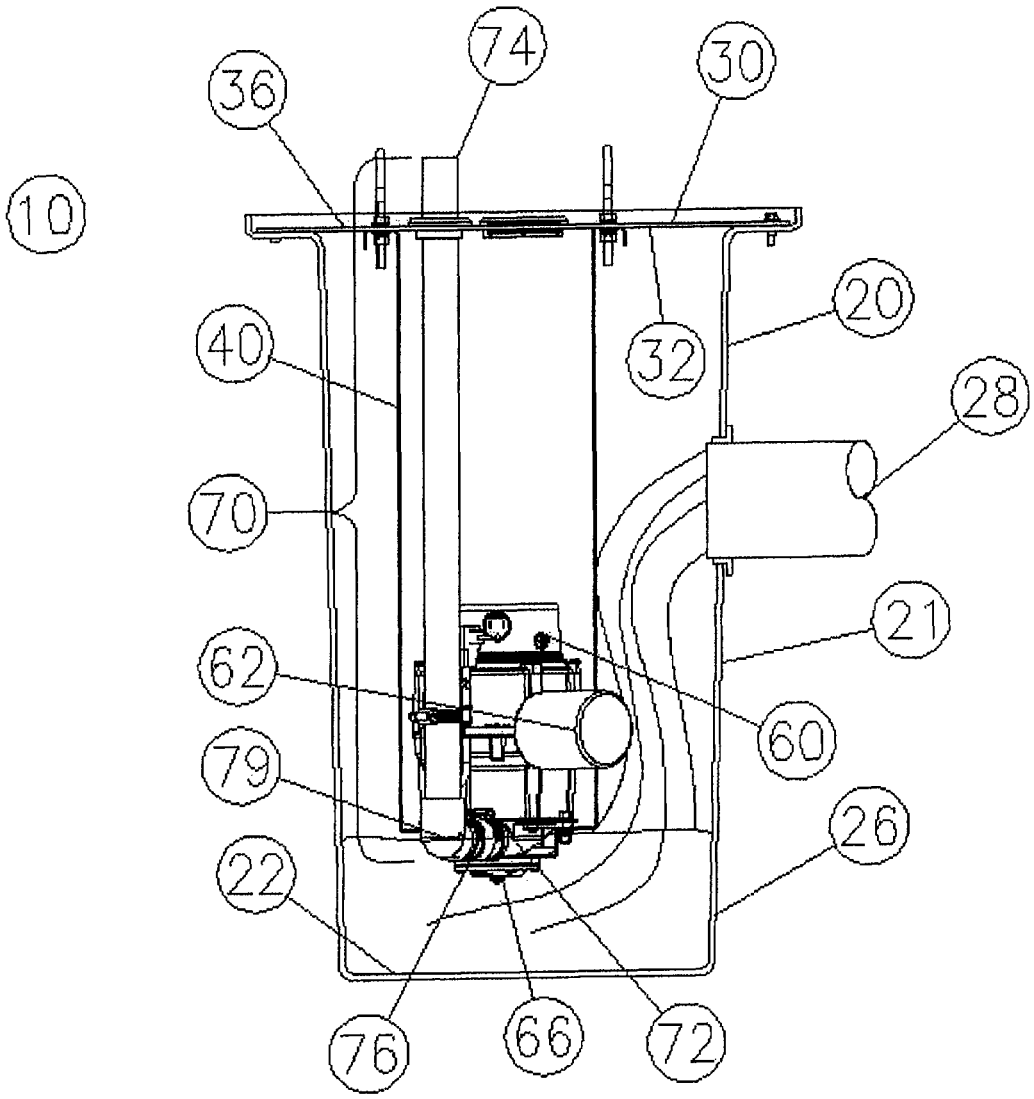
FIG. 2 is a side cut-away view of the grinder pump basin system of FIG. 1 showing waste water entering an inlet in a side of the basin and striking the bracket.
Figure 3:
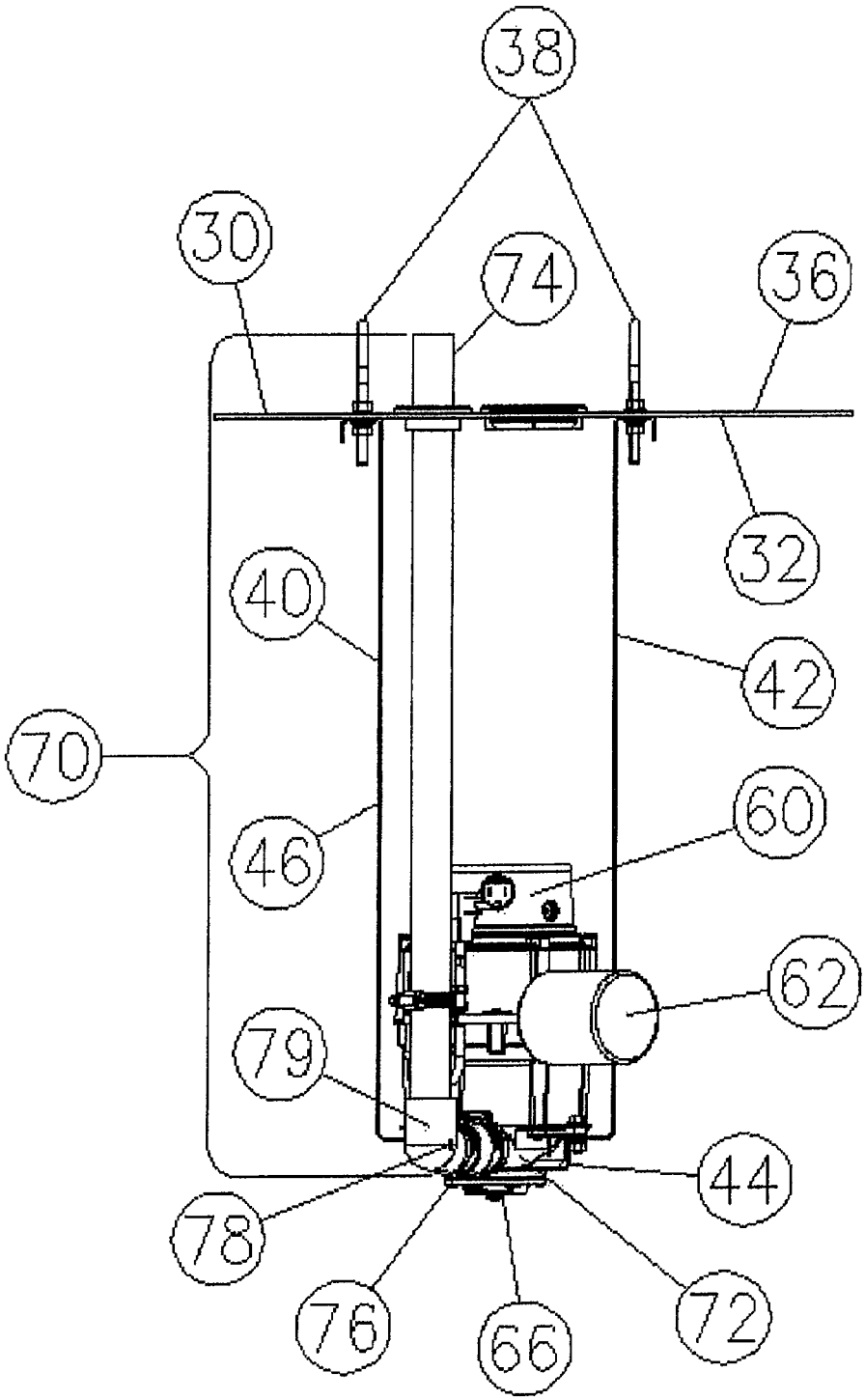
FIG. 3 is a side view of the grinder pump basin system without the basin showing the bracket secured to the cover plate with the grinder pump secured to the bracket and a discharge system attached to the grinder pump, with discharge piping passing through the cover plate.

Referring to the FIGS. 1 and 2, there is shown a grinder pump basin system (10) which includes a basin (20) with a cover plate (30) securing an open, upper portion of the basin, a bracket (40) secured to the cover plate, a grinder pump (60) secured to and through the bracket, and a discharge system (70) secured to the grinder pump, which discharges waste water and ground up solids through the cover plate after treatment.

In one embodiment, the basin (20) is a conventional, tube-shaped structure with an open top (24) and a bottom inside surface (22) of a closed bottom portion (26) of the basin. The sides (21) of the basin include an inlet opening (28) for introduction of waste water and solids into the basin. (See FIG. 2.) The basin can be constructed of conventional materials, such as polypropylene. Various diameters of these basins are conventionally used including diameters of about 18 inches (46 cm) and 24 inches (61 cm).

The cover plate (30) is constructed of conventional materials, such as steel, stainless steel or conventional polymeric materials, and is secured to the basin (20) by conventional securing means, such as screws passing through the outside and inside surfaces (32,36) of the cover plate into the basin (20), as shown in FIGS. 1 and 2.

Secured to the cover plate is the bracket (40) as shown in FIGS. 2-5 and 7. The bracket (40) is secured to the inside surface (32) of the cover plate as shown, for example, in FIG. 9.

The bracket (40) comprises a front portion (42), which extends from where it is attached to the inside surface (32) of the cover plate (30) of the basin (20), downward to a location adjacent to or below a bottom portion (66) of the grinder pump, as shown in FIGS. 1-5 and 11. Secured to, or a continuation of, the front portion (42) of the bracket is a lower portion (44) of the bracket, which extends under and around the grinder pump (60) and to which the grinder pump is secured. A bottom portion of the grinder pump (66), including preferably a cutter plate (80) and a cutter blade (90), extends through an opening (48) in the lower portion of the bracket. By the bottom portion of the grinder pump extending below the bracket, that portion can interact with waste water or solids contained in the basin. See FIG. 11. Attached to, or a continuation of, the lower portion of the bracket is a rear portion of the bracket (46), which extends from the lower portion of the bracket upwards to the cover plate, where it is secured to the inside surface (32) of the cover plate (30) in a manner similar to the manner of securing the front portion (42) of the bracket to the inside surface (32) of the cover plate (30), as shown in FIG. 9.

Figure 9:
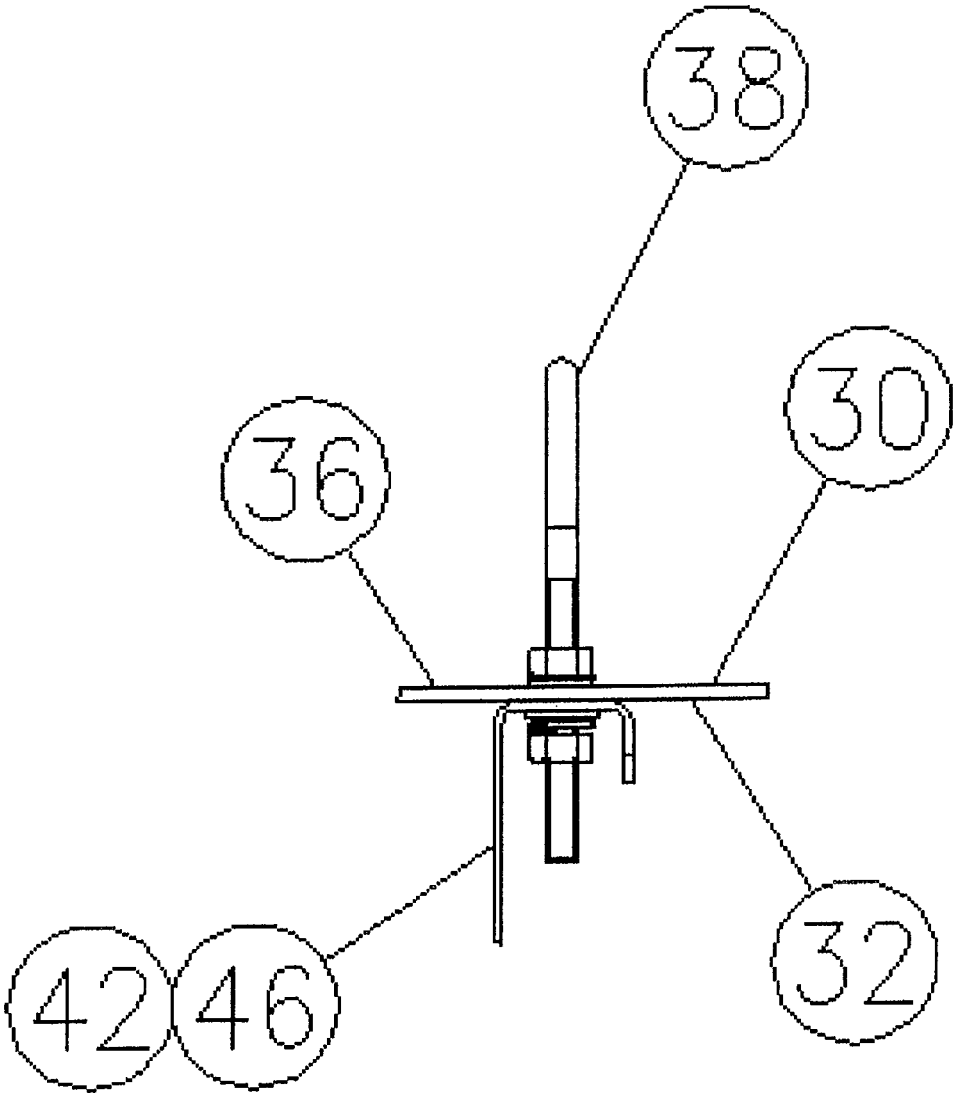
FIG. 9 is a cutaway side view of one end of the bracket secured to the cover plate using a "U" bolt.

Preferably, both the front portion (42) and the rear portion (46) of the bracket (40) are secured to the inside surface (32) of the cover plate (30) using U-shaped bolts (38) which extend through and are secured to the cover plate, as shown in FIGS. 3-5 and 9. The U-shaped bolts are secured to the cover plate by conventional securing means, such as by use of washers and nuts, as shown in FIG. 9. Because the U-shaped portion of these U-shaped bolts extend above the outside surface (36) of the cover plate (30), they can be used to lift and move the entire grinder pump basin system (10).

Figure 10:
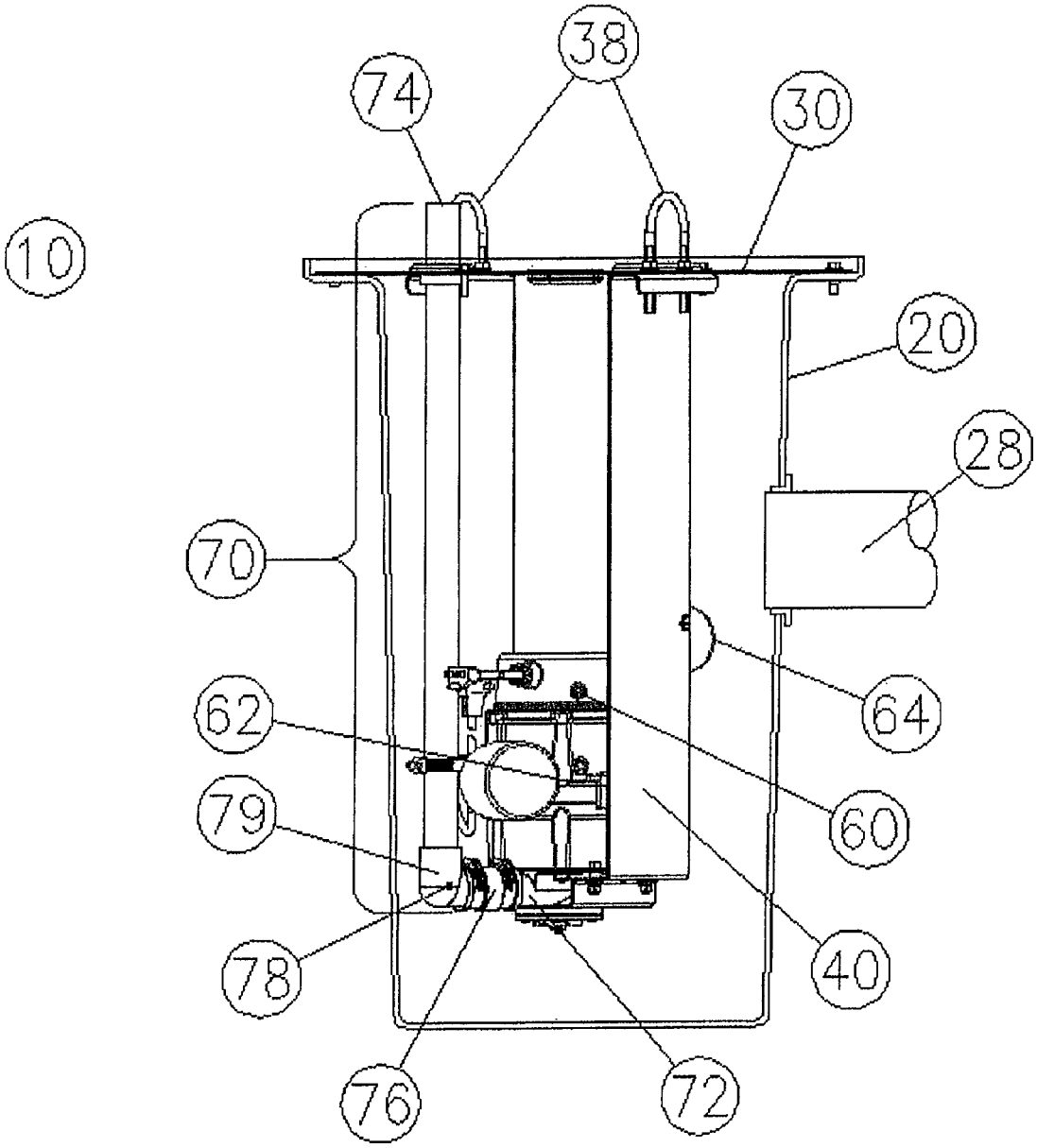
FIG. 10 is a perspective view of the system showing the bracket secured to the cover plate with an angled front portion of the bracket.

The front (42) and, optionally, the rear (46) portions of the bracket (40) are preferably rectangular in shape and are of sufficient width such that when waste water enters the basin (20) through the inlet opening (28) of the basin under force, that waste water strikes the front portion (42) of the bracket (40) and is substantially prevented from directly impacting the grinder pump by the front portion of the bracket, as shown in FIG. 2. While a rectangular shape of the front portion (42) and the rear portion (46) of the bracket (40) is one option, other shapes may also be used, as desired, as long as undesired impact of waste water with the grinder pump (60), when the waste water enters the basin, is limited or prevented. In one preferred embodiment, the front portion of the bracket is also angled downward to preferentially direct the flow of the waste water and solids that enter the basin through the inlet opening (28) of the basin from a direction perpendicular to the flow of the waste water and solids around one or both sides of the grinder pump and/or toward the bottom portion (26) of the basin (20), as shown in FIG. 10.

Figure 7:
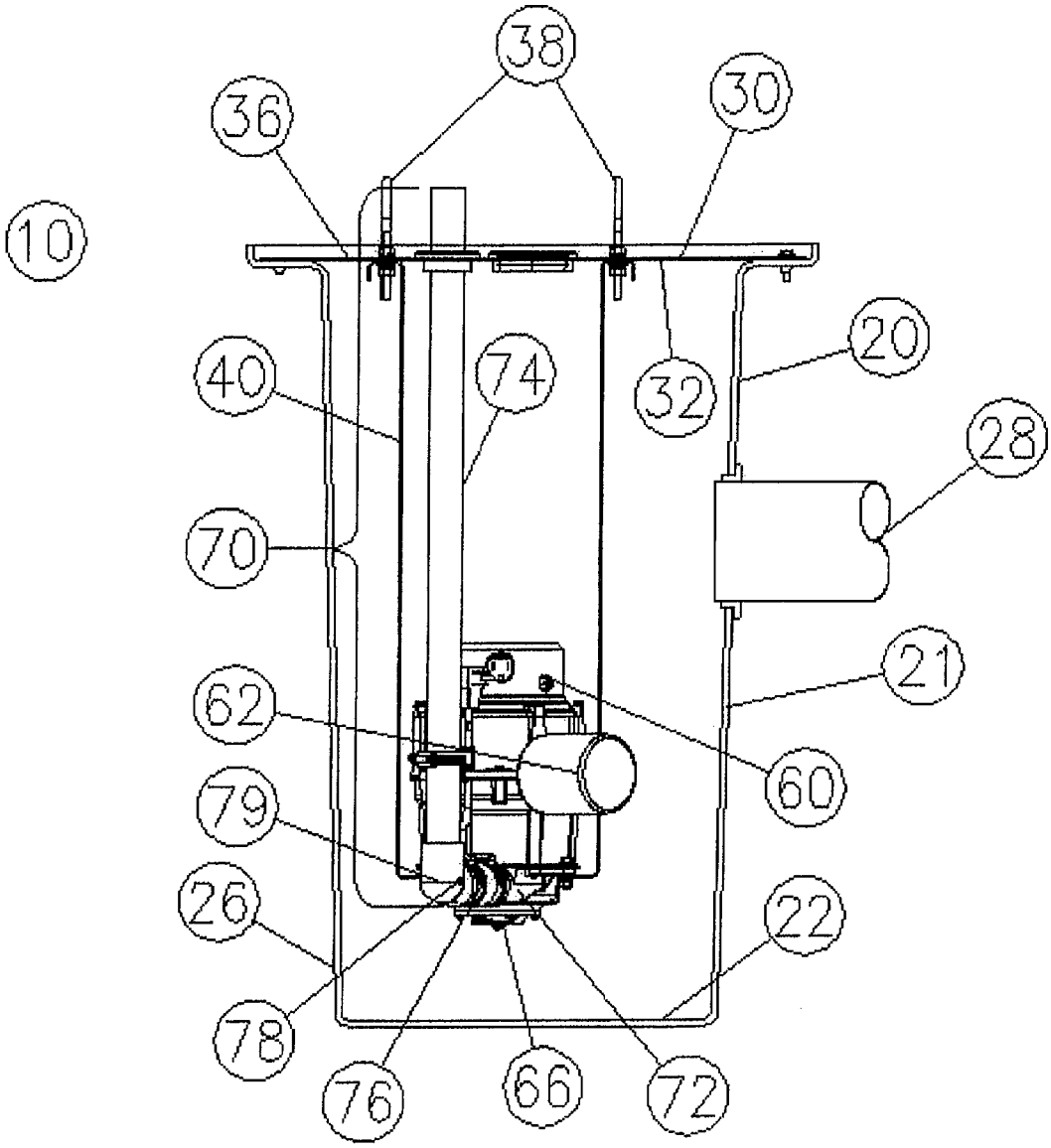
FIG. 7 is a cut away view of the basin with the grinder pump and bracket in place showing the grinder pump located above the bottom surface of the basin.

In a preferable embodiment the bracket is produced from stainless steel and is preferably at least about 1/16 inch (0.15 cm) in thickness. Although it is not necessary that the front portion of the bracket (40) entirely covers the grinder pump (60), the width of the front portion (42) of the bracket in front of the inlet opening (28) should be coordinated to substantially prevent interaction of waste water and solids with the grinder pump (60) as they enter the basin, as shown in FIGS. 2 and 7. Thus, preferably the front portion (42) of the bracket is from about 4 to 8 inches in width, although its width may vary depending on the overall size of the grinder pump (60).

Because of the overall width and design of the bracket (40), solids which enter the basin (20) through the inlet opening (28) do not directly impact or clog the grinder pump (60). Further, because the bracket holds the grinder pump above the bottom portion (26) of the basin, solids that enter the basin pass below the grinder pump and do not interfere with operation of the grinder pump until they enter the grinder pump that extends through the opening (48) in the lower portion (44) of the bracket (40) to be ground up during conventional operations by the cutter plate (80) and cutter blade (90).

In addition, the bracket (40) absorbs some or all of the vibration and undesired torque that is generated by the grinder pump while in operation and prevents or limits that vibration and torque from interfering with the performance of the grinder pump (60) within the grinder pump basin system (10).

Figure 11:
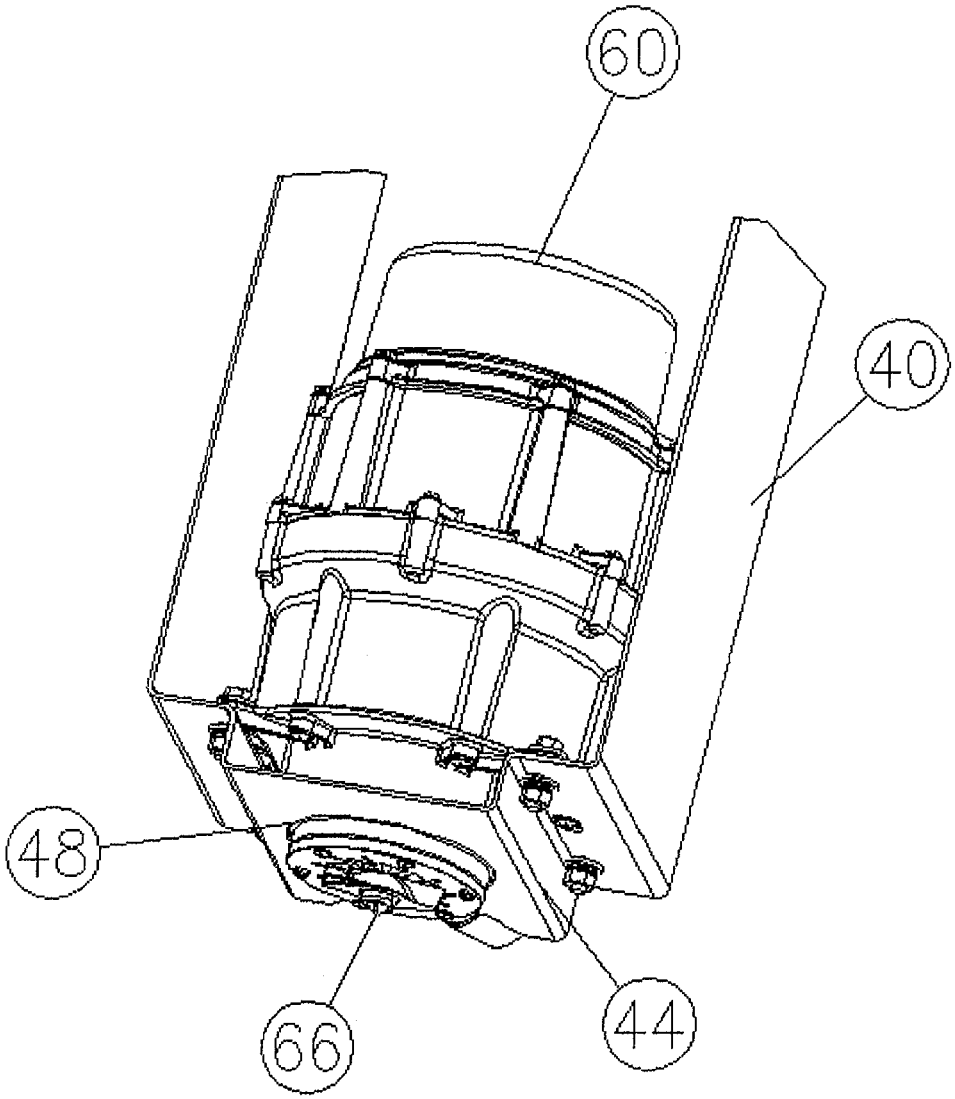
FIG. 11 is a cutaway, perspective bottom view of the grinder pump secured to the bracket showing the cutter plate and the cutter blade of the pump extending through an opening in the lower portion of the bracket.

The grinder pump (60) may be a conventional grinder pump, such as a Shark Series® pump sold by Zoeller Pump Company. The bottom portion (66) of the grinder pump, preferably including the cutter plate (80) and cutter blade (90), extends through the opening (48) in the lower portion (44) of the bracket. The grinder pump is secured to the bracket by conventional means, such as bolts, nuts and washers, as shown in FIG. 11. Special bolts with a ribbed neck feature can also be utilized for securing the pump. The grinder pump, while secured to the bracket (40), is not directly secured to the cover plate (30) or any other component of the basin (20). This method of securing the grinder pump only to the bracket isolates the grinder pump from other components of the system and prevents or limits the vibration and torque produced by the grinder pump during operation from adversely impacting other components of the system.

Figure 4:
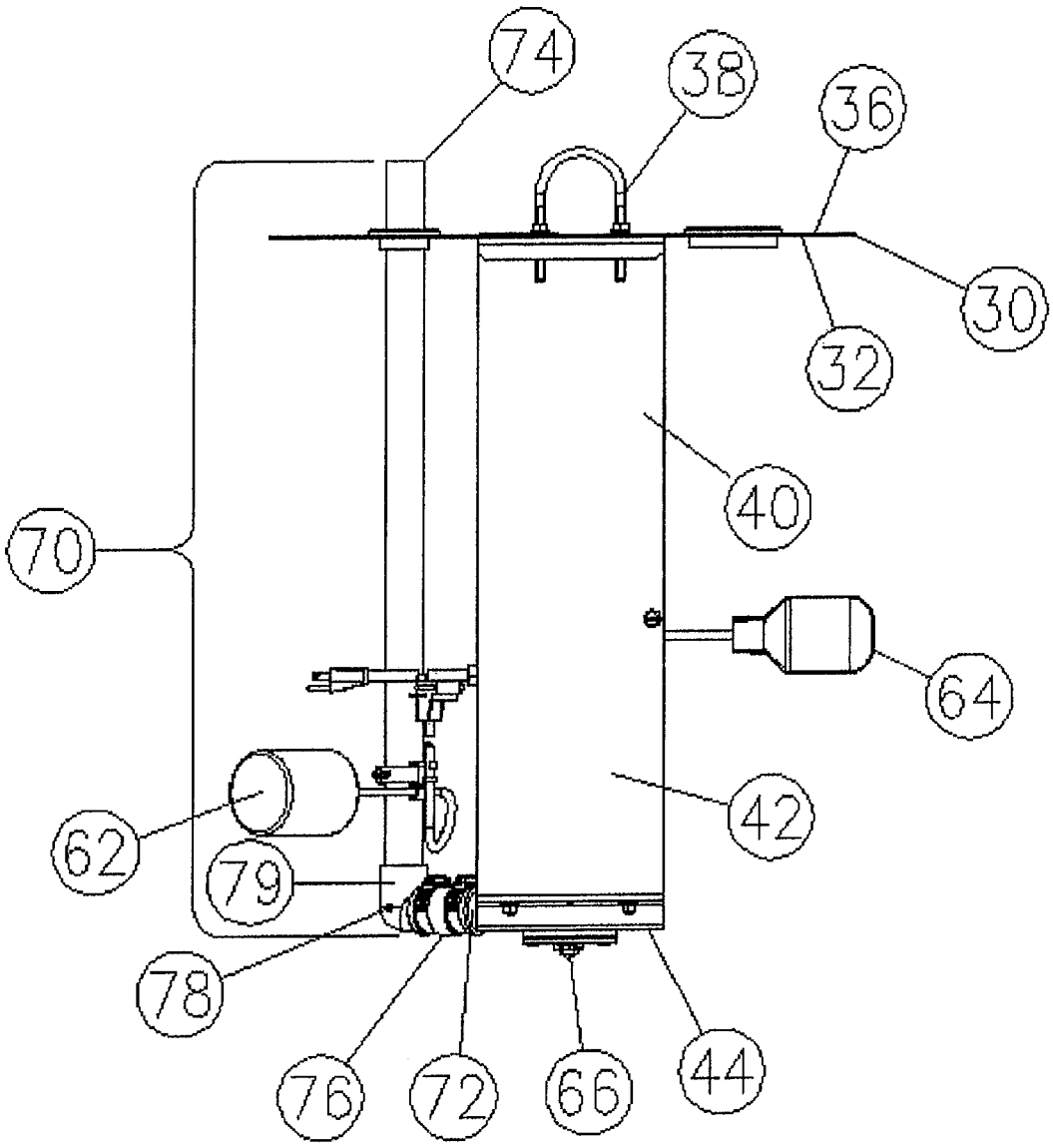
FIG. 4 shows the system of FIG. 3 rotated 90 degrees around an axis of the grinder pump showing the front of the bracket.
Figure 5:
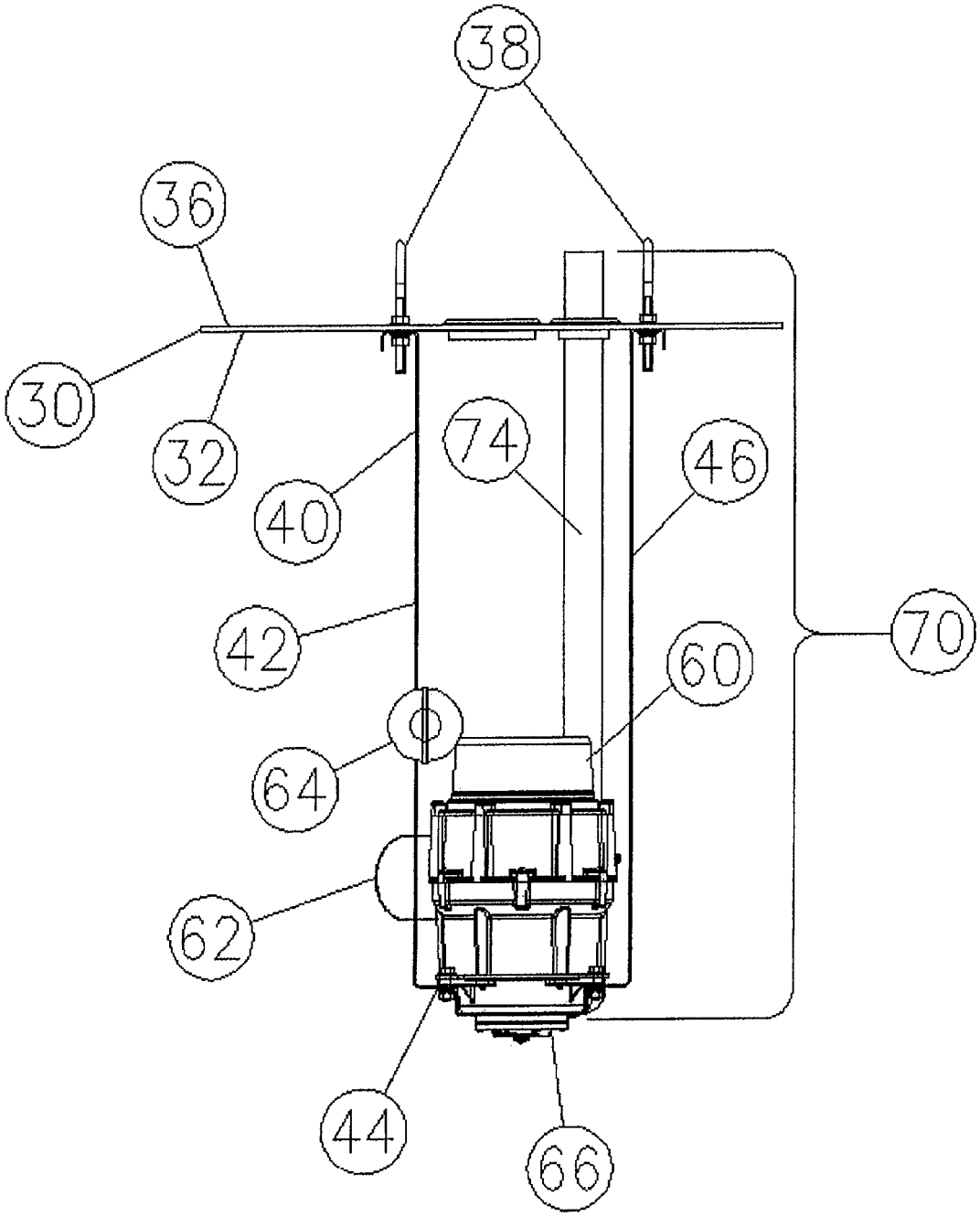
FIG. 5 shows the system of FIG. 4 rotated an additional 90 degrees around the axis of the grinder pump.
Figure 6:
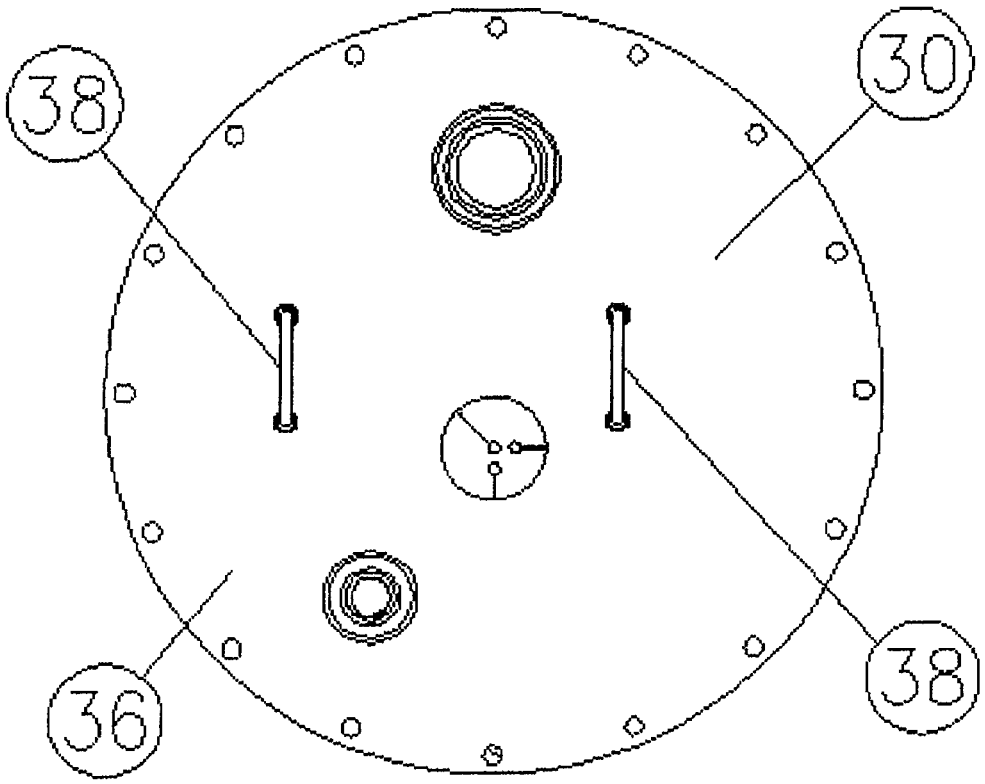
FIG. 6 is a plan view of the cover plate.

Operating in association with the grinder pump are preferably a conventional on/off float (62) and an alarm float (64), as shown in FIG. 4. These floats may be attached to the discharge system (70), which is discussed in more detail later, or they may be attached to the bracket (40) and operate conventionally with the grinder pump.

The grinder pump (60) includes conventional components such as a motor, a pump housing, an impeller, a shaft, a base, and a pump inlet. In some embodiments the pump operates as a centrifugal pump and may include seals capable of sealing the pump even if operated at high speeds. (For a more detailed discussion of those conventional components of the pump, see application Ser. No. 12/749,134, which application is incorporated by reference herein.) With reference to FIGS. 11, 12*a*, 12*b*, 13*a* and 13*b*, the bottom portion of the grinder pump (66) includes the cutter plate (80) and cutter blade (90), each of which is a component of the grinder pump. The cutter plate and cutter blade may be produced from any suitable material, including but not limited to stainless steel.

Figure 12B:
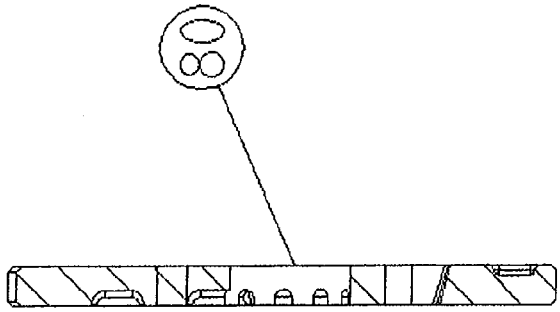
FIG. 12*b* is a side view of the cutter plate.
Figure 12A:
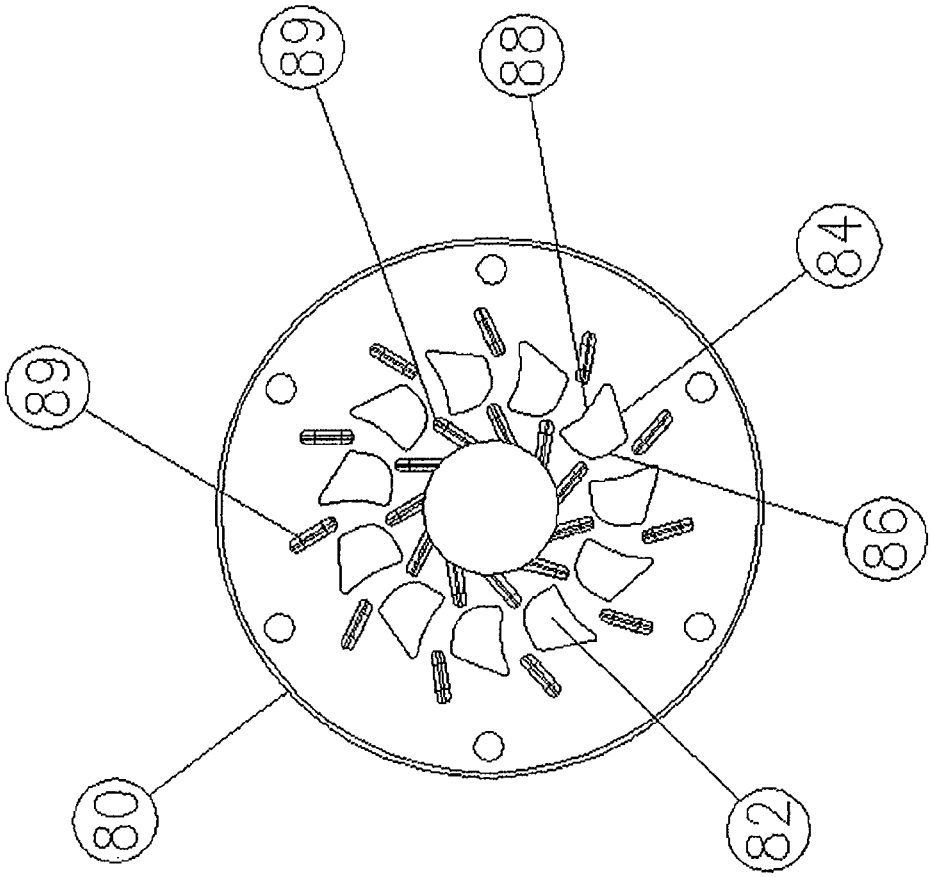
FIG. 12*a* is a plan view of the portion of the cutter plate of the grinder pump which interacts with the grinder blade.

The cutter plate (80), as shown in FIGS. 12*a* and 12*b*, includes a series of openings (82) extending therethrough. Fluid and solid material entering the pump inlet must pass through these openings. By the interaction of the cutter blade (90) and the openings (82) in the cutter plate, solids are ground into small enough size to be disposed through the discharge system (70).

The cutter blade (90) of the grinder pump is located substantially adjacent to the cutter plate (80), as shown in FIG. 11. The cutter blade rotates in relation to the cutter plate so that solids are cut as they pass through the openings (82) in the cutter plate by the interaction of the cutter blade and the openings in the cutter plate. In certain embodiments the cutter blade is directly in contact with the cutter plate. Alternatively, the cutter blade may not be in direct contact with the cutter plate and may be separated a small distance from the surface of the cutter plate, although the cutter plate and the cutter blade are located substantially parallel and adjacent to each other. The particular arrangement of the cutter plate and the cutter blade is dependent upon the goal and operation of the grinder pump (60). Alternative arrangements are discussed in more detail in application Ser. No. 12/749,134, which application is incorporated by reference herein.

The openings (82) in the cutter plate (80) are preferably formed with a particular shape or shapes to assist in the cutting of solids as they enter the grinder pump. For example, in application Ser. No. 12/749,134, these openings are substantially oval or oblong in shape and may be angled in the direction of rotation of the cutter blade. In an alternative embodiment, as shown in FIGS. 12*a* and 12*b*, these openings have a different shape. This shape includes a straight cutting edge (84), which forms an acute angle with a slightly concave cutting edge (86) of the openings. The inside surfaces of the straight cutting edge and the slightly concave cutting edge are angled to form a sharp cutting surface which assists in cutting solid materials that enter these openings. The other ends of these two cutting edges are joined by a third, generally convex cutting edge (88). These three cutting edges form a preferred embodiment of the openings (82) of the cutter plate (80). It has been surprisingly discovered that by use of this unique shape for the openings in the cutter plate, in coordination with the shape of the cutting blade (90), solid materials are cut more efficiently than has been done in the past. With this particular shape, solid materials which enter the openings in the cutter plate are efficiently and expertly cut. This shape increases the cutting ability, reduces motor torque and the cutting force required to grind up solids as they enter the pump inlet.

Figure 13B:
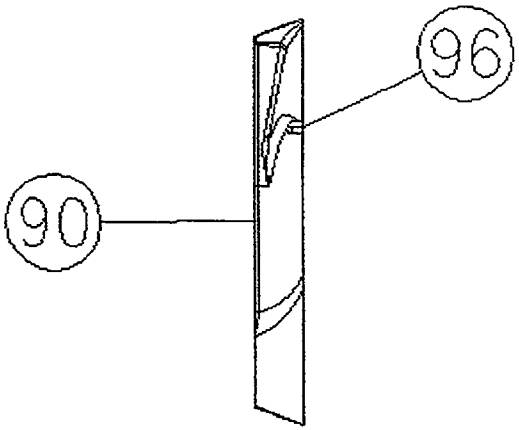
FIG. 13*b* is a side view of the cutter blade.
Figure 13A:
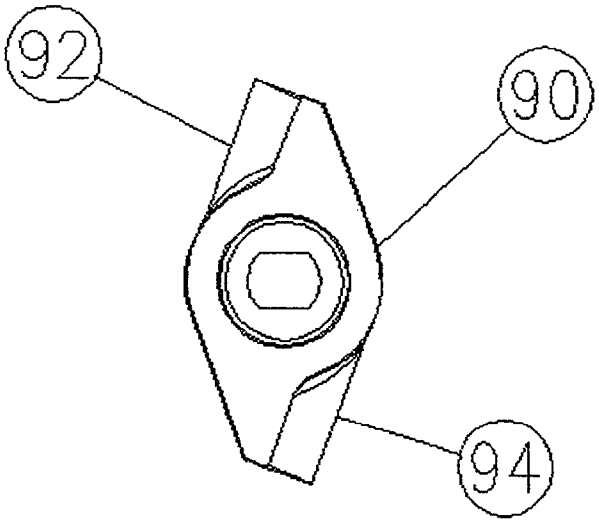
FIG. 13*a* is a plan view of the portion of the cutter blade of the grinder pump which is secured directly to or adjacent to the cutter plate.

The shape of the cutter blade (90) also assists in the efficient operation of the grinder pump. One embodiment of this shape is discussed in application Ser. No. 12/749,134, whose application is incorporated herein by reference. In an alternative embodiment, as shown in Figures 13*a* and 13*b*, the cutter blade (90) contains a pair of angled cutting edges (92,94). These cutting edges are angled forming an acute angle with a sharp edge on the bottom of the cutter blade closest to the openings (82) in the cutter plate (80).

In addition to the shape of the cutting edges (84, 86, 88) of the openings (82) in the cutter plate (80), the position of the cutting edges (92,94) of the cutter blade in relation to the cutting edges (84 and 86) of the openings (82) in the cutter plate (80) also assists in the efficient cutting of solids that enter the openings (82). Because of the angling of the openings (82) in the cutter plate (80), as shown in FIGS. 12*a* and 12*b*, the cutting edges (92,94) of the cutter blade (90) cross the openings (82) such that solids are forced between the straight cutting edge (84) and the concave cutting edge (82) forcing solids to the meeting point of these edges and thereby efficiently cutting the solids and forcing them through the openings. In this embodiment the angles of the cutting edges (92,94) of the cutter blade (90) interact with the cutting edges (84, 86) of the openings (82) in the cutter plate (80) to efficiently cut solid materials as they enter the grinder pump.

In some grinder pumps, such as is disclosed in application Ser. No. 12/749,134, which is incorporated herein by reference, there have been secured to the bottom portion of the grinder pump (66) a ring which is secured to the outside edge of the cutter plate (80) beyond the openings (82) therein. This ring has been necessary in some grinder pumps to channel fluid and materials into the openings in the openings in the cutter plate. However, with the preferred design of the openings in the cutter plate (80) and the preferred design of the cutter blade (90) of this disclosure, it has been surprisingly discovered that this ring is not necessary.

This ring is also not necessary because of the presence of relief cuts (89) in the surface of the cutter plate (80) and relief cuts (96) in the surface of the cutter blade (90) as shown in FIGS. 12*a* and 13*b*. These relief cuts (89) can be of any shape, length or depth as is useful, but are generally about the same length as the straight cutting edge (84) of the cutter plate and comprise a rounded trough-like cut, as shown in FIG. 12*a*. The relief cuts (96) in the surface of the cutter blade, as shown in FIG. 13*b* are approximately the same shape as the relief cuts (89) in the cutter plate (80). During operation of the grinder pump, these relief cuts assist in the cutting of solids and prevent the space between the cutter blade (90) and the cutter plate (80) from becoming clogged with solid materials. Along with the other features of the grinder pump, these elements assist in the channeling in the fluid and materials into the pump inlet and reduce the opportunity for solids to catch and become trapped underneath the cutter blade (90) or wrap around the shaft of the grinder pump, thereby eliminating the need for a ring to be secured to the bottom surface of the grinder pump.

It will also be understood by those skilled in the art that this grinder pump with cutter plate and cutter blade can be used for other systems than the disclosed system, such as in a pump basin under a sink for grinding up food and other materials or as a waste pumping system.

Secured to the grinder pump (60) is also a discharge system (70) for discharging waste water and ground up solids from the basin (20) as shown in FIGS. 1-5, 7, 8 and 10. The discharge system comprises a pump discharge outlet (72), which is secured to the grinder pump (60) and discharges waste water and ground up solids from the pump, a discharge pipe (74), which is attached directly or indirectly to the pump discharge outlet, to discharge waste water and ground up solids through the cover plate (30) of the basin (20) to a waste water disposal system (not shown) and, in one embodiment, a flexible discharge coupling (76), which is secured between the pump discharge outlet and the discharge pipe, as shown in FIGS. 3-5 and 8. Alternatively, the wastewater and ground up solids can be discharged through an opening in the side of the basin. The flexible discharge coupling is preferably made of a natural or synthetic flexible polymeric material, such as rubber, that is both flexible and suitable for the environment of conventional use and, as with the bracket (40), absorbs vibration and torque of the grinder pump (60), when the grinder pump is in operation.

Figure 8:
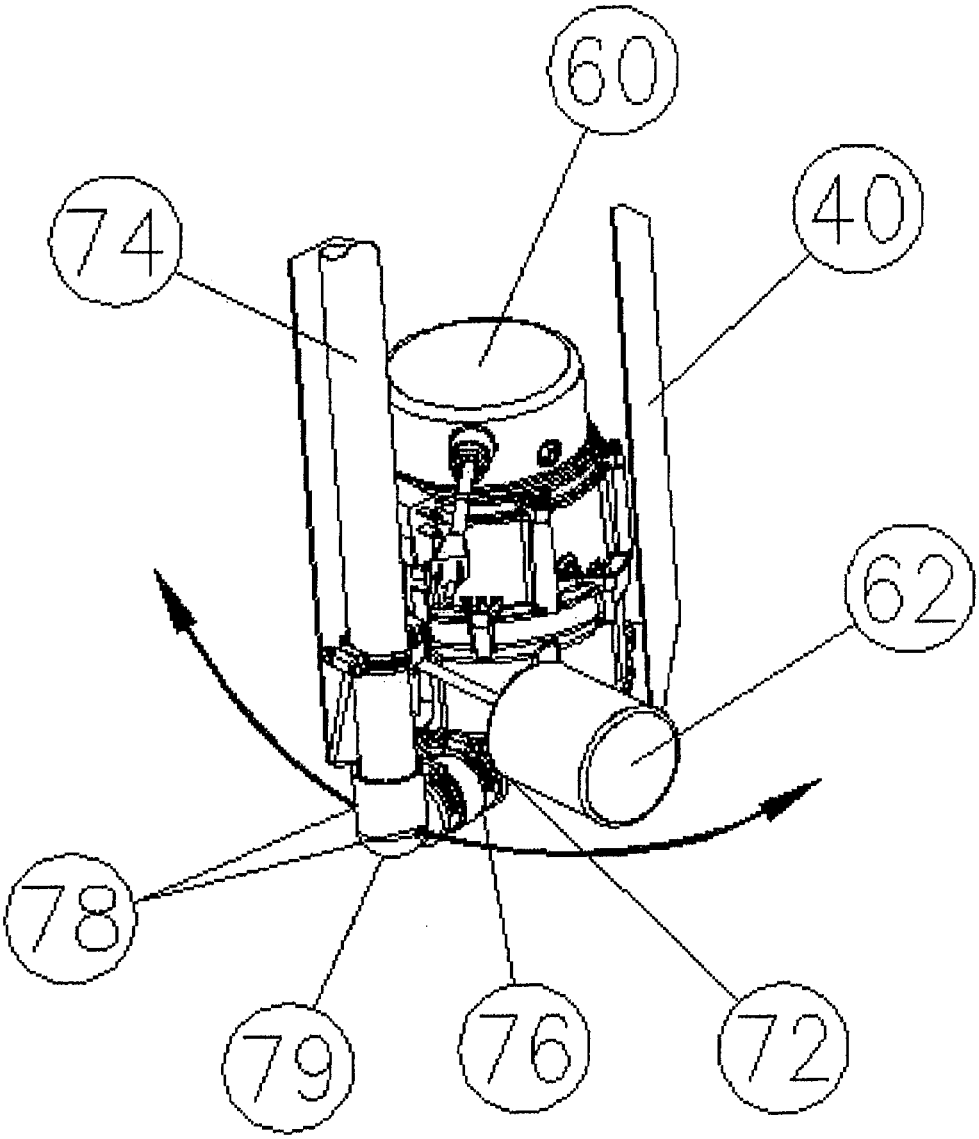
FIG. 8 is a cutaway, perspective view of the grinder pump, bracket and discharge system showing an elbow of the discharge system between the pump and the discharge pipe which contains flow directional jets and a flexible discharge coupling.

In an additional embodiment, an element of the discharge system (70) is an elbow (79), as shown in FIG. 8. The elbow may be a component of the discharge pipe (74), the pump discharge outlet (72), the flexible discharge coupling (76), or a separate elbow element (not shown) of the discharge system. In one embodiment, one or more flow directional jets (78) are included in the elbow although these flow directional jets may also be included in the discharge pipe, pump discharge outlet, or flexible discharge coupling. The flow directional jets preferably are openings in the elbow which permit waste water to be forced out of the discharge system (70) as the waste water and ground up solids are discharged. The size of these openings can be from about one-eighth of an inch to one-third of an inch in diameter (0.6-0.8 cm). The flow directional jets direct the flow of waste water in a direction or directions such that they encourage flow of the waste water away from the floats and other components of the system (10), particularly the grinder pump. In addition, the flow directional jets preferably produce a circulating flow of the waste water and solids contained within the bottom portion (26) of the basin (20) and thereby limit or prevent sediment from building up in the bottom portion (26) of the basin. This limitation on build-up of sediment in the bottom portion of the basin (20) is important as it reduces the formation of sulfur-bearing microbs, which generate $H_2S$, which can turn into sulfuric acid, resulting in degradation of the basin (20) and other components of the grinder pump basin system (10). In addition, the formation of $H_2S$ results in an unpleasant odor. Thus, the swirling action created by the flow directional jets reduces several problems present with earlier grinder pump systems.

In operation, a basin (20) of the desired size is provided to which a cover plate (30) of the appropriate size is also provided for securing to the open top (24) of the basin. Secured to the inside surface (32) of the cover plate is the bracket (40). Preferably, the front portion (42) and rear portion (46) of the bracket are secured to the inside surface (32) of the cover plate (30) by a pair of U-shaped bolts (38). These U-shaped bolts assist in the moving of the grinder pump basin system. Secured through an opening (48) in the lower portion (44) of the bracket (40) is the grinder pump (60). By proper placement of the bracket within the basin, the front portion (42) of the bracket is located directly adjacent to the inlet opening (28) in the basin, such that waste water and solids, which enter the basin through the inlet opening, immediately contact the front portion of the bracket and are directed away from the grinder pump, thereby preventing interaction of the waste water and solids with the operation of the grinder pump. The cutter plate (80), cutter blade (90), the uniquely shaped openings (82) in the cutter plate and other elements of the system operate in combination to effectively and efficiently cut up solids for disposal from the grinder pump basin system.

Secured to the grinder pump is the discharge system (70). The discharge system includes a pump discharge outlet (72) of the grinder pump to which is attached the discharge pipe (74) which discharges waste water and ground up solids through the cover plate for discharge from the system. Preferably, a flexible discharge coupling (76) is secured between the pump discharge outlet and the discharge pipe. In addition, preferably one or more, preferably two, float directional jets (78) are contained in an elbow (79) of the discharge system to generate a flow of liquid when waste water and ground up solids are being discharged through the discharge system. The flow of the waste water through the flow directional jets creates a swirling motion of waste water and solids in the bottom portion (26) of the basin, thereby keeping the grinder pump (60) and associated components clear of solid materials and preventing a buildup of sediment in the basin.

It should be understood that the foregoing description is only illustrative of the various disclosed inventions. Various alternatives and modifications can be devised by those skilled in the art without departing from the scope of the invention. The present invention is intended to embrace alternatives, modifications, and variances which fall within the scope of the attached claims.

The invention claimed is:

1. A grinder pump comprising a cutter plate attached to an inlet of the grinder pump; and a cutter blade attached to the grinder pump and located parallel and adjacent to the cutter plate;

wherein angled openings extend entirely through the cutter plate and wherein the openings comprise three sides, wherein one side comprises a straight cutting edge, a second side adjacent to the straight cutting edge comprises a concave shaped cutting edge; wherein a third side of the angled openings joins an end of the first side with an end of the second side and consists essentially of a curved convex shaped edge; wherein the cutter plate further comprises relief cuts in a surface of the cutter plate, wherein the cutter blade comprises a pair of angled cutting edges, wherein each angled cutting edge forms an acute angle creating sharp cutting edges, and wherein during operation of the grinder pump, the angled cutting edges of the cutter blade cross the angled openings such that solid material entering said angled openings is forced between the straight cutting edge and the concave shaped cutting edge.

2. The grinder pump of claim 1 wherein no ring is secured to an outside edge of the cutter plate to secure the cutter plate to the grinder pump.

3. The grinder pump of claim 1 wherein the cutter blade further comprises relief cuts in a surface of the cutter blade.

4. The grinder pump of claim 1 wherein a motor for the grinder pump is a fractional horsepower motor.

5. The grinder pump of claim 1 wherein the cutter plate further comprises relief cuts in a surface of the cutter plate, wherein the relief cuts extend inwardly on the surface of the cutter plate from the openings.

6. The grinder pump of claim 5 wherein said relief cuts are at least as long as a length of the straight cutting edge of the opening in the cutter plate.

7. The grinder pump of claim 5 wherein the relief cuts have a rounded, trough-like shape.

8. The grinder pump of claim 1 wherein both the cutter plate and the cutter blade further comprise relief cuts with a similar general shape and size in a surface of the cutter blade and the cutter plate.

9. A grinder pump comprising a cutter plate attached to an inlet of the grinder pump; and a cutter blade attached to the grinder pump and located parallel and adjacent to the cutter plate; wherein angled openings extend entirely through the cutter plate and wherein those openings consist essentially of three sides, wherein one side consist essentially of a straight cutting edge, a second side adjacent to the straight cutting edge consist essentially of a concave shaped cutting edge; wherein a third side of the angled openings joins an end of the first side with an end of the second side and consist essentially of a curved convex shaped edge; wherein the cutter blade comprises a pair of angled cutting edges; and wherein each angled cutting edge forms an acute angle creating sharp cutting edges, and wherein during operation of the grinder pump, the angled cutting edges of the cutter blade cross the angled openings such that solid material entering said angled openings is forced between the straight cutting edge and the concave shaped cutting edge.

10. The grinder pump of claim 9 wherein the cutter blade further comprises relief cuts in a surface of the cutter blade.

11. The grinder pump of claim 9 wherein no ring is secured to an outside edge the cutter plate to secure the cutter plate to the grinder pump.

12. The grinder pump of claim 9 wherein the cutter plate further comprises relief cuts in a surface of the cutter plate.

13. The grinder pump of claim 9 wherein a motor for the grinder pump is a fractional horsepower motor.

14. The grinder pump of claim 9 wherein the cutter plate further comprises relief cuts in a surface of the cutter plate, wherein the relief cuts extend inwardly on the surface of the cutter plate from the openings.

15. The grinder pump of claim 14 wherein said relief cuts are at least as long as a length of the straight cutting edge of the opening in the cutter plate.

16. The grinder pump of claim 14 wherein the relief cuts have a rounded, trough-like shape.

17. The grinder pump of claim 9 wherein both the cutter plate and the cutter blade further comprise relief cuts with a similar general shape and size in a surface of the cutter blade and the cutter plate.

* * * * *